US008051913B2

(12) United States Patent
Huang et al.

(10) Patent No.: US 8,051,913 B2
(45) Date of Patent: Nov. 8, 2011

(54) DOWNHOLE GAP SEALING ELEMENT AND METHOD

(75) Inventors: Tianping Huang, Spring, TX (US); Richard Y. Xu, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 96 days.

(21) Appl. No.: 12/391,646

(22) Filed: Feb. 24, 2009

(65) Prior Publication Data

US 2010/0212899 A1 Aug. 26, 2010

(51) Int. Cl.
*E21B 33/12* (2006.01)

(52) U.S. Cl. ..... 166/387; 166/187; 166/195; 277/322; 277/336; 277/343

(58) Field of Classification Search ..... 166/387, 166/187, 195; 277/322, 336, 343
See application file for complete search history.

(56) References Cited

U.S. PATENT DOCUMENTS 2,144,026 A * 1/1939 Park ..... 277/340
2,306,160 A * 12/1942 Freyssinet ..... 277/605
2,751,235 A * 6/1956 Watts et al. ..... 277/322
2,754,136 A * 7/1956 Phillips ..... 277/322
3,909,421 A * 9/1975 Gaddis ..... 507/211
4,300,775 A * 11/1981 Ringel ..... 277/589
4,391,925 A * 7/1983 Mintz et al. ..... 523/130
4,442,241 A * 4/1984 Drake et al. ..... 523/130
4,445,576 A * 5/1984 Drake et al. ..... 166/291
4,475,594 A * 10/1984 Drake et al. ..... 166/294
4,503,170 A * 3/1985 Drake et al. ..... 523/130
4,633,950 A * 1/1987 Delhommer et al. ..... 166/295
4,797,159 A 1/1989 Spangle
4,913,232 A * 4/1990 Cheymol et al. ..... 166/285
5,002,431 A * 3/1991 Heymans et al. ..... 405/129.6
5,942,031 A 8/1999 Cheung
5,997,003 A * 12/1999 Turner ..... 277/339
6,446,717 B1 * 9/2002 White et al. ..... 166/187
6,530,574 B1 * 3/2003 Bailey et al. ..... 277/314
6,896,049 B2 5/2005 Moyes
7,216,706 B2 * 5/2007 Echols et al. ..... 166/285
7,299,882 B2 * 11/2007 Brezinski et al. ..... 166/387
7,316,271 B2 1/2008 Moyes
7,320,367 B2 * 1/2008 Brezinski et al. ..... 166/387

(Continued)

OTHER PUBLICATIONS

Gomez, J.A., et al. "Full-Scale Well Model Tests of a New Chemical Plug System for Zone Isolation in Horizontal Wells," SPE Drilling & Completion, vol. 17, No. 2: pp. 83-87, Jun. 2002. Paper No. 77978-PA.

(Continued)

*Primary Examiner* — Jennifer H Gay
(74) *Attorney, Agent, or Firm* — Cantor Colburn LLP

(57) ABSTRACT

A downhole sealing element includes, a malleable member having at least one closed wall cavity therein positionable downhole in a gap defined between downhole members, and a chemical disposed within the at least one closed wall cavity. The malleable member is deformable to fill variations in a dimension of the gap and the chemical is reactive to form a nonflowable element.

16 Claims, 2 Drawing Sheets

U.S. PATENT DOCUMENTS

| | | | | |
|---|---|---|---|---|
| 7,363,986 | B2 * | 4/2008 | Brezinski et al. | 166/387 |
| RE41,118 | E * | 2/2010 | Brezinski et al. | 166/387 |
| 7,665,537 | B2 * | 2/2010 | Patel et al. | 166/387 |
| 7,669,653 | B2 * | 3/2010 | Craster et al. | 166/187 |
| 7,673,692 | B2 * | 3/2010 | Kunz | 166/387 |
| 7,743,825 | B2 * | 6/2010 | O'Malley et al. | 166/179 |
| 2002/0166672 | A1 * | 11/2002 | White et al. | 166/387 |
| 2004/0055758 | A1 * | 3/2004 | Brezinski et al. | 166/384 |
| 2005/0016740 | A1 * | 1/2005 | Aldaz et al. | 166/387 |
| 2005/0023003 | A1 * | 2/2005 | Echols et al. | 166/384 |
| 2005/0199401 | A1 * | 9/2005 | Patel et al. | 166/387 |
| 2006/0005973 | A1 * | 1/2006 | Harrall et al. | 166/384 |
| 2006/0090903 | A1 * | 5/2006 | Gano et al. | 166/384 |
| 2007/0267201 | A1 * | 11/2007 | Brezinski et al. | 166/387 |
| 2008/0053664 | A1 * | 3/2008 | Naquin et al. | 166/387 |
| 2008/0230234 | A9 * | 9/2008 | Gano et al. | 166/384 |
| 2008/0251250 | A1 * | 10/2008 | Brezinski et al. | 166/179 |
| 2009/0071641 | A1 * | 3/2009 | Gaudette et al. | 166/118 |
| 2009/0277649 | A9 * | 11/2009 | Gano et al. | 166/384 |
| 2010/0090410 | A1 * | 4/2010 | Doane et al. | 277/323 |
| 2010/0139930 | A1 * | 6/2010 | Patel et al. | 166/387 |

OTHER PUBLICATIONS

Romero-Zeron, L, et al. "Characterization of Crosslinked Gel Kinetics and Gel Strength by Use or NMR," SPE Reservoir Evaluation & Engineering, vol. 11, No. 3: pp. 439-453, Jun. 2008. Paper No. 86548-PA.

Saidin, S., et al. "A New Approach for Optimizing Cement Design to Eliminate Microannulus in Steam Injection Wells," International Petroleum Technology Conference, Kuala Lumpur, Malaysia , Dec. 3-5, 2008. Paper No. IPTC-12407-MS.

Chow, T.W., et al. "The Rheological Properties of Cement Slurries: Effects of Vibration, Hydration Conditions, and Additives," SPE Production Engineering, vol. 3, No. 4: pp. 543-550, Nov. 1988. Paper No. 13936-PA.

Boukhelifa, L, et al. "Evaluation of Cement Systems for Oil- and Gas-Well Zonal Isolation in a Full-Scale Annular Geometry," SPE Drilling & Completion, vol. 20, No. 1: pp. 44-53, Mar. 2005. Paper No. 87195-PA.

* cited by examiner

DOWNHOLE GAP SEALING ELEMENT AND METHOD

BACKGROUND

Sealing one tubular to another tubular in a downhole wellbore of a hydrocarbon recovery operation is a common task. Metal-to-metal sealing systems have been developed for such seals. Small dimensional deviations in the metal-to-metal contacting surfaces, however, can prevent complete sealing between the two metal surfaces. Systems and methods to permit sealing in the presence of these minor dimensional deviations are well received in the art.

BRIEF DESCRIPTION

Disclosed herein is a downhole sealing element. The element includes, a malleable member having at least one closed wall cavity therein positionable downhole in a gap defined between downhole members, and a chemical disposed within the at least one closed wall cavity. The malleable member is deformable to fill variations in a dimension of the gap and the chemical is reactive to form a nonflowable element.

Further disclosed herein is a method of sealing a downhole gap. The method includes, positioning a malleable sealing element having at least one closed wall cavity therewithin in a gap between downhole members, deforming the malleable sealing element thereby filling variations in a dimension of the gap, and forming a nonflowable element with a chemical housed within at least one of the at least one closed wall cavity.

Further disclosed herein is a downhole tubular sealing system. The system includes, a first tubular having a deformable portion positionable downhole within a second tubular, a malleable ring having at least one closed wall cavity therein disposed at the deformable portion, and a chemical disposed within the at least one closed wall cavity being reactive to form a nonflowable element. The malleable ring is deformable to fill a variable radial dimension of an annular gap defined between the deformable portion in a deformed configuration and the second tubular.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
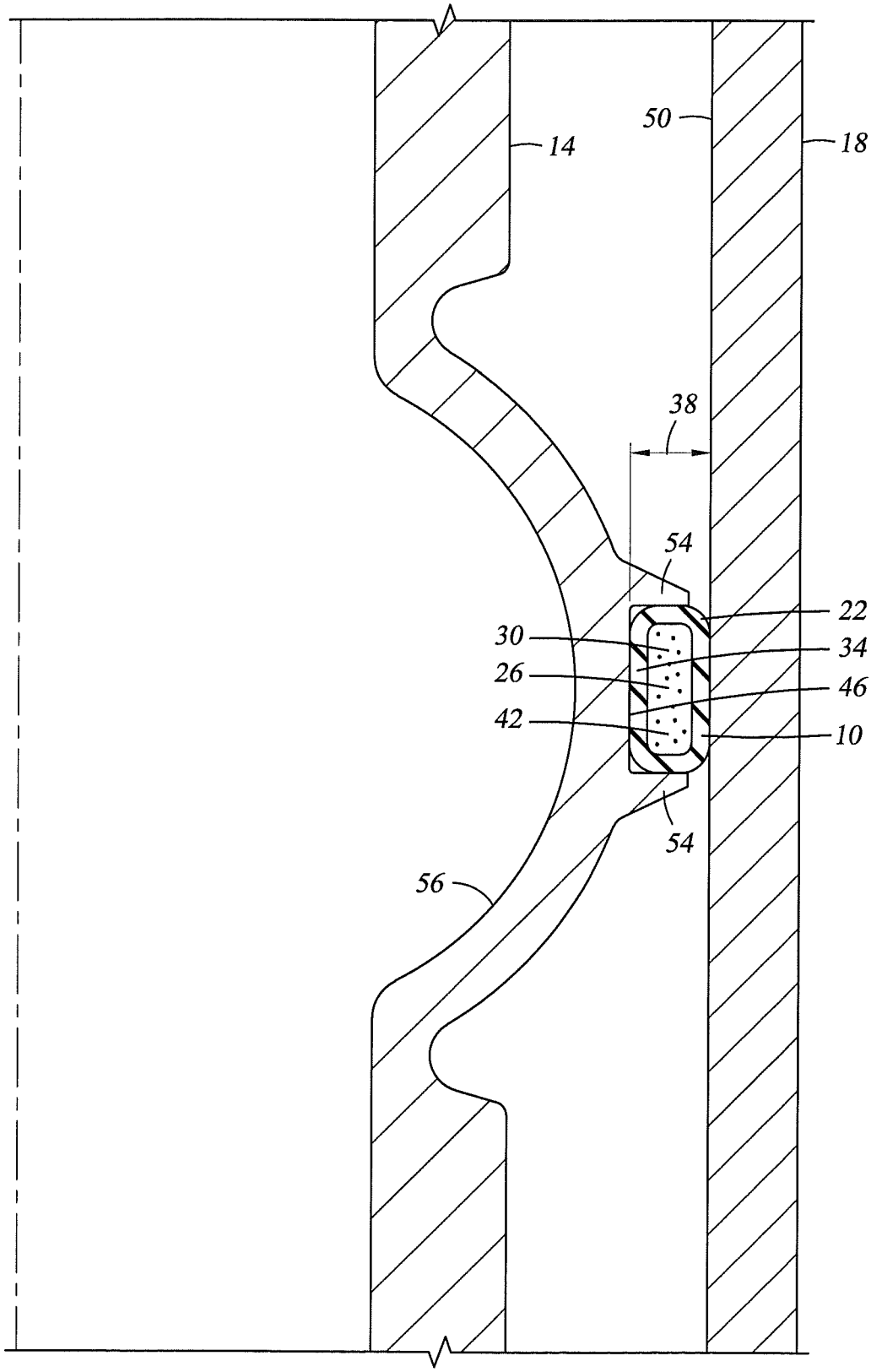
FIG. 1 depicts a partial cross sectional side view of a downhole sealing element disclosed herein positioned downhole between two tubulars in a sealing configuration.

Referring to FIG. 1 an embodiment of a downhole sealing element 10 disclosed herein is illustrated sealing two tubulars 14, 18 to one another. The sealing element 10 includes, a malleable ring 22 having a closed cavity 26 therewithin with a chemical 30, which is flowable and illustrated herein as a liquid, located within the closed cavity 26. In this embodiment the cavity 26 is continuous around the complete circumferential dimension of the ring 22 similar in fashion to that of a bicycle tire inner tube, for example. Walls 34 of the ring 22 are made of a deformable material such as a polymer or a rubber, for example, such that the ring 22 is conformable to available space, such as the space of an annular gap 38 defined between the two tubulars 14, 18. The annular gap 38 may vary in a radial dimension at different locations around the perimeter thereof. The chemical 30 is free to flow throughout the cavity 26 to redistribute itself within the changing dimensions of the ring 22. The chemical 30 is reactive in response to specific events or exposure to different substances, as will be discussed below, such that a nonflowable element 42, such as a solid, forms. Once the nonflowable element 42 is formed, the malleability of the sealing element 10 is reduced and consequently is not easily deformed by pressure, for example. In so doing the sealing element 10 maintains sealing engagement with surfaces 46, 50 of the tubulars 14, 18.

The sealing element 10 can be sized in relation to the annular gap 38 and radial locating walls 54 so that the volume of the sealing element 10 is about equal to or slightly greater than the volume of the space defined by the annular gap 38 and locating walls 54. This volumetric relationship will cause the sealing element 10 to exert pressure on the surfaces 46 and 50 to assure it is sealingly engaged therewith. Embodiments wherein the chemical 30 is incompressible can result in significant sealing engagement pressures.

In fact, sealing engagement pressures can be selected that result in the walls 34 of the ring 22 rupturing in response to pressures in excess of a burst strength threshold pressure. Upon rupture of the walls 34 the chemical 30 is directly exposed to the downhole environment and can commingle with downhole fluids, such as water, mud and/or oil, for example. As such, the formation of the nonflowable element 42 can be the result of a chemical reaction between the chemical 30 and one of the downhole fluids. Additionally, the chemical 30 can be formulated to volumetrically expand during the nonflowable element 42 forming reaction to further enhance the sealing of the sealing element 10 by increasing the sealing pressures between the element 10 and the surfaces 46 and 50 even further. Examples of chemicals with some of the above properties are found in U.S. Pat. No. 5,942,031 to Cheung and U.S. Pat. No. 4,797,159 to Spangle, the entire contents of which are incorporated herein by reference.

Figure 2:
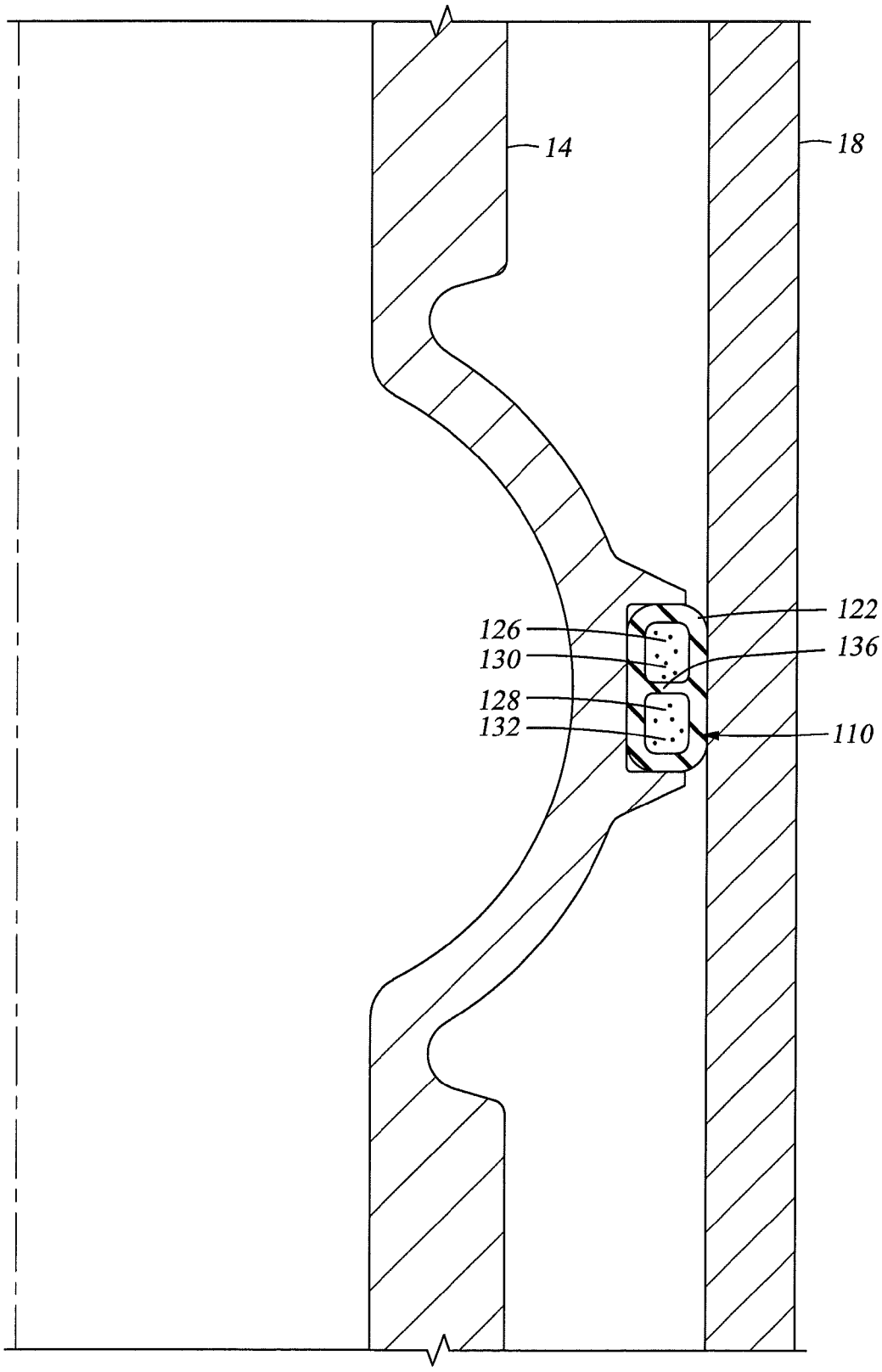
FIG. 2 depicts a partial cross sectional side view of an alternate downhole sealing element disclosed herein positioned downhole between two tubulars in a sealing configuration.

Referring to FIG. 2, an alternate embodiment of a downhole sealing element 110 is illustrated. The sealing element 110 includes a malleable ring 122 with two closed wall cavities 126 and 128 therewithin. Alternate embodiments may, however, have more than two closed wall cavities. The first cavity 126 has a first chemical 130 housed therein and the second cavity 128 has a second chemical 132 housed therein. A rupturable divider 136 separates the first cavity 126 from the second cavity 128. Application of stress to the divider 136 causes the divider 136 to rupture thereby permitting commingling of the first chemical 130 with the second chemical 132. The chemicals 130 and 132 are reactive with one another to form a nonflowable element (not shown) (optionally with volumetric expansion during the reaction). Examples of applicable reactive chemicals are magnesium oxide particle slurry and borate that react to form solid magnesium borate compounds and, sodium carbonate and calcium chloride that react to form solid calcium carbonate. These solids in particular may be well suited to this application since they are inorganic crystals that can tolerate the commonly encountered downhole conditions of high temperatures and high pressures.

Although the foregoing embodiments require commingling of chemicals to form the nonflowable element 42, alternate embodiments may form a nonflowable element without such commingling being required. Such embodiments could use chemicals that form nonflowable elements in response to changes in temperature or pressure, for example. Such an embodiment could rely on the high temperatures or high pressures typically encountered in a downhole environment to initiate the solidification reaction. Yet other embodiments could use chemicals that rely on a specific duration of time to expire before they self-solidify.

Referring again to FIG. 1, the sealing element 10 is shown herein sealing an inconsistently sized annular gap 38 formed when a radially deformable portion 56 of the tubular 14 is expanded radially outwardly such that each of the locating walls 54 contact the surface 50 of the tubular 18 in at least two places. This situation is due to non-circularity of the inner surface 50 of the tubular 18, or the non-circularity of the outer surface 46 of the deformable portion 56 or both. Consequently, a radial dimension of the annular gap 38 varies at different locations about the perimeter, as described above. If both the surfaces 46 and 50 were circular, the locating walls 54 could seal directly with the surface 50 negating the need for the sealing element 10.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A downhole sealing element, comprising:

a malleable member having at least one closed wall cavity therein positionable downhole in a gap defined between downhole members, the malleable member being deformable to fill variations in a dimension of the gap; and a chemical disposed within the at least one closed wall cavity, the chemical being reactive to form a nonflowable element while being within the closed wall cavity without being exposed to matter from outside the at least one closed wall cavity.

2. The downhole sealing element of claim 1, wherein the malleable member is substantially circular.

3. The downhole sealing element of claim 2, wherein the at least one closed wall cavity extends perimetrically completely around the malleable member.

4. The downhole sealing element of claim 1, wherein the malleable member is polymeric.

5. The downhole sealing element of claim 1, wherein the chemical is a liquid.

6. The downhole sealing element of claim 1, wherein the chemical reacts to form the nonflowable element in response to a change in at least one selected from the group consisting of temperature, pressure and time.

7. The downhole sealing element of claim 1, wherein the chemical is reactive to form the nonflowable element substantially without volumetric expansion.

8. The downhole sealing element of claim 1, wherein the chemical includes at least one of the group consisting of, magnesium oxide, borate, sodium carbonate and calcium chloride.

9. A method of sealing a downhole gap, comprising:

positioning a malleable sealing element having at least one closed wall cavity therewithin in a gap between downhole members;

deforming the malleable sealing element thereby filling variations in a dimension of the gap; and forming a nonflowable element with a chemical housed within at least one of the at least one closed wall cavity without exposing the chemical to matter from outside of all of the at least one closed wall cavity.

10. The method of sealing a downhole gap of claim 9 further comprising reacting the chemical in the forming of the nonflowable element.

11. The method of sealing a downhole gap of claim 9 further comprising sealing the malleable sealing element to the downhole members.

12. The method of sealing a downhole gap of claim 9 further comprising substantially maintaining a volume of the chemical during the forming of the nonflowable element.

13. The method of sealing a downhole gap of claim 9 further comprising expanding the nonflowable element.

14. The method of sealing a downhole gap of claim 9 further comprising altering temperature of the chemical to initiate the forming of the nonflowable element.

15. The method of sealing a downhole gap of claim 9 further comprising altering pressure acting on the chemical to initiate the forming of the nonflowable element.

16. A downhole tubular sealing system, comprising:

a first tubular having a deformable portion positionable downhole within a second tubular;

a malleable ring having at least one closed wall cavity therein disposed at the deformable portion, the malleable ring being deformable to fill a variable radial dimension of an annular gap defined between the deformable portion in a deformed configuration and the second tubular; and a chemical disposed within the at least one closed wall cavity being reactive to form a nonflowable element while being within the closed wall cavity without being exposed to matter from outside the at least one closed wall cavity.

* * * * *